US007061444B2

(12) United States Patent
Pintos et al.

(10) Patent No.: US 7,061,444 B2
(45) Date of Patent: Jun. 13, 2006

(54) RLSA ANTENNA HAVING TWO ORTHOGONAL LINEAR POLARIZATIONS

(75) Inventors: Jean-François Pintos, Bourgbarre (FR); Philippe Chambelin, Chateaugiron (FR); Ali Louzir, Rennes (FR)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 10/525,181

(22) PCT Filed: Aug. 4, 2003

(86) PCT No.: PCT/EP03/50357

§ 371 (c)(1),
(2), (4) Date: Feb. 22, 2005

(87) PCT Pub. No.: WO2004/019451

PCT Pub. Date: Mar. 4, 2004

(65) Prior Publication Data

US 2006/0001587 A1 Jan. 5, 2006

(30) Foreign Application Priority Data

Aug. 23, 2002 (FR) ..... 02 10507

(51) Int. Cl.
*H01Q 13/10* (2006.01)

(52) U.S. Cl. ..... 343/771; 343/770
(58) Field of Classification Search ..... 343/770, 343/771; 333/157
See application file for complete search history.

(56) References Cited

U.S. PATENT DOCUMENTS 3,032,762 A * 5/1962 Kerr ..... 343/771
3,063,049 A * 11/1962 Kelly ..... 343/771
4,716,415 A 12/1987 Kelly
5,661,498 A * 8/1997 Goto et al. ..... 343/771

FOREIGN PATENT DOCUMENTS

DE 4212886 10/1993

OTHER PUBLICATIONS

M. Ando et al: "A Linearly Polarized Radial Line Slot Antenns" IEEE Transactions on Antennas and Propagation, IEEE Inc. New York, US, vol. 36, No. 12, Dec. 1, 1988, pp. 1675-1680.
Copy of Search Report Dated Nov. 18, 2003.

* cited by examiner

*Primary Examiner*—Tan Ho
(74) *Attorney, Agent, or Firm*—Joseph J. Laks; Robert D. Shedd; Brian J. Cromarty

(57) ABSTRACT

The network antenna of the RLSA type in the form of a radial waveguide has a feed structure allowing simultaneous excitation of the antenna in two orthogonal linear polarizations. The feed structure, essentially placed to the rear of the antenna, consists of a circular waveguide placed at the centre of the radial waveguide and coupled to the latter by two circular slots for the excitation of the antenna in a first linear polarization and of a coaxial waveguide surrounding the circular waveguide and coupled to the radial waveguide by radial slots, the coaxial waveguide being excited by a ring-shaped waveguide placed coaxially on the outer periphery of the coaxial waveguide and coupled to the latter by slots distributed around the inner periphery of the ring for the excitation of the antenna in a second linear polarization orthogonal to the first linear polarization.

5 Claims, 1 Drawing Sheet

RLSA ANTENNA HAVING TWO ORTHOGONAL LINEAR POLARIZATIONS

This application claims the benefit, under 35 U.S.C. § 365 of International Application PCT/EP03/150357, filed Aug. 4, 2003, which was published in accordance with PCT Article 21(2) on Mar. 4, 2004 in English and which claims the benefit of France patent application No. 0210507, filed Aug. 23, 2002.

BACKGROUND OF THE INVENTION

The invention relates to network antennas of the radial waveguide type with linear slots, known as RLSAs (Radial Line Slot Antennas), that are intended to be more particularly used in satellite communications systems. In these communications systems, transmission to the satellite and reception from the satellite take place along two orthogonal (circular or linear) polarizations, respectively, although the transmission and reception frequency bands are generally different. This decoupling between the two links—the uplink and the downlink—of the communications system is enhanced the better the isolation between the two orthogonal polarizations in the network antenna. The identical approach of two orthogonal polarizations is used in wireless terrestrial communications systems, known as LMDSs (Local Multipoint Distribution Systems), that operate in the 40 GHz millimetric bands.

A network antenna of the RLSA type having a feed structure that allows the antenna to be excited in two orthogonal linear polarizations is known from the document by F. J. Boebels & K. C. Kelly entitled "*Arbitrary Polarization From Annular Slot Planar Antennas*" published in IRE TRANSACTIONS ON ANTENNAS AND PROPAGATION, July 1961, pages 342–349. The feed structure for this antenna consists of two radial cavities, one placed above the other inside the antenna, each cavity being excited by a circular waveguide placed at the centre of one of the two faces of the antenna. The two ports of the feed structure are thus placed on either side of the antenna, this having the effect of creating masking and perturbation regions at the front of the antenna and therefore downgrading the radiation characteristics of the latter.

SUMMARY OF THE INVENTION

The object of the invention is to remedy this drawback and for this purpose a network antenna of the RLSA type in the form of a radial waveguide according to the invention is characterized in that the feed structure, essentially placed to the rear of the antenna, consists of a circular waveguide placed at the centre of the radial waveguide and coupled to the latter by two circular slots for the excitation of the antenna in a first linear polarization and of a coaxial waveguide surrounding the circular waveguide and coupled to the radial waveguide by radial slots, the coaxial waveguide being excited by a ring-shaped waveguide placed coaxially on the outer periphery of the coaxial waveguide and coupled to the latter by slots distributed around the inner periphery of the ring for the excitation of the antenna in a second linear polarization orthogonal to the first linear polarization.

According to the features of the network antenna according to the invention:

the first linear polarization is excited by means of a first rectangular input waveguide propagating the $TE_{01}$, fundamental mode, oriented along an axial direction of the antenna, in the circular waveguide;

the second linear polarization is excited by means of a second rectangular input waveguide propagating the $TE_{01}$ fundamental mode, oriented in a direction perpendicular to the axial direction of the antenna, in the ring-shaped waveguide;

the two rectangular input waveguides are placed parallel to each other;

the two rectangular input waveguides are placed one beneath the other.

With this construction of the feed structure for the antenna, the first rectangular waveguide may be above or below the second rectangular waveguide and various topologies may be envisaged for the arrangement of the electronic cards for transmitting/receiving the microwave signals. Moreover, the construction of the feed structure based on imbricated waveguides is relatively simple to produce.

BRIEF DESCRIPTION OF THE DRAWINGS

One embodiment of an RLSA network antenna according to the invention is described below and illustrated in the drawings.

DESCRIPTION OF PREFERRED EMBODIMENTS

Figure 1:
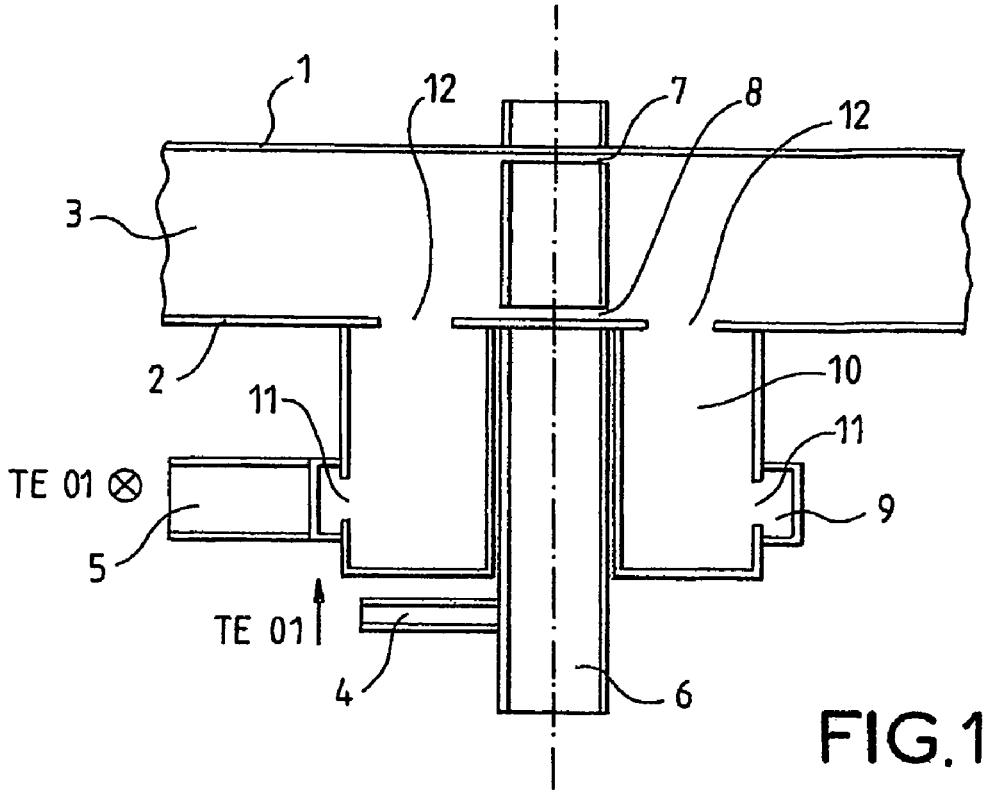
FIG. 1 shows the network antenna with a feed structure according to the invention, the unit being seen in axial section of the antenna.
Figure 2:
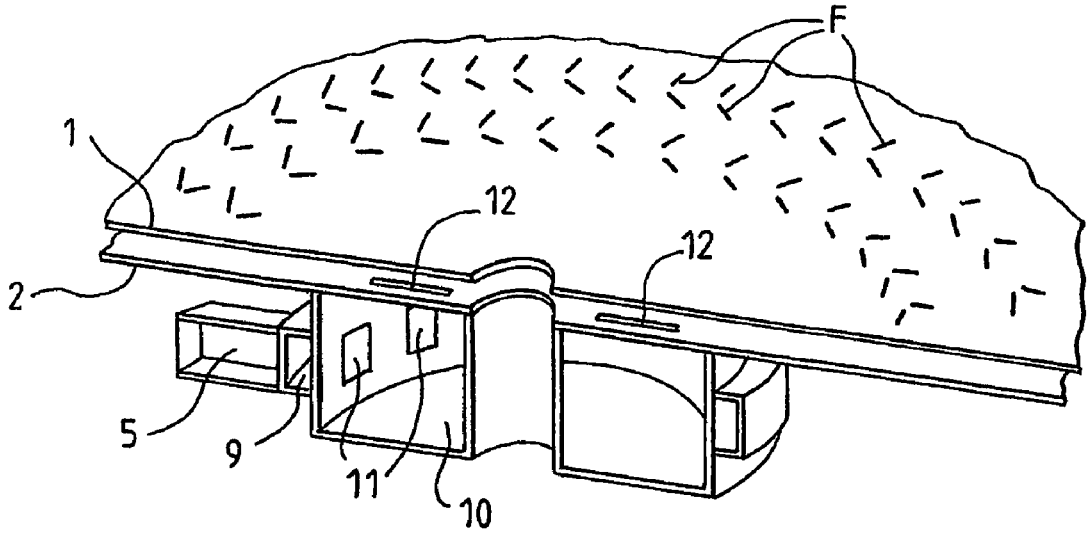
FIG. 2 is a partial perspective view in axial section of the antenna.

In FIG. 1, the RLSA-type network antenna comprises two coaxial circular conducting plates 1, 2 that may be separated from each other by a dielectric material in order to form a radial waveguide 3. FIG. 2 shows the front face 1 of the antenna, which has an array of discrete radiating slots F arranged in concentric circles. It is obvious to those skilled in the art that the radiating slots may have another arrangement.

The feed structure for the network antenna 3 is essentially placed adjacent to the rear face 2 of the antenna such that its front face is not masked by an element that disturbs its radiation pattern.

The feed structure is designed to simultaneously excite, in transmission and/or reception, the two modes $E_{11}$ and $H_{11}$ by means of a pair of rectangular input waveguides 4, 5 that are placed at the rear of the antenna and extend, in the embodiment illustrated, perpendicular to the central axis A of the antenna. These two input waveguides 4, 5 may be placed parallel to each other and with one below the other in order to constitute two independent excitation ports. However, other arrangements may be adopted without departing from the scope of the invention.

To excite the first mode $E_{11}$, the first input waveguide 4 is coupled to the radial waveguide 3 via a circular waveguide 6 that is placed at the centre of the rear face 2 of the antenna. The input waveguide 4 is fed with its $TE_{01}$ fundamental mode, the electric field of which, indicated by an arrow in FIG. 1, is parallel to the direction A. The circular waveguide 6 propagates the $TM_{01}$ mode into the radial waveguide 3 via two circular coupling slots 7, 8 spaced apart inside the radial waveguide 3 along the axis A by a half-wavelength of the guided wave in the $TM_{01}$ mode.

To excite the second mode $H_{11}$, the second input waveguide 5 is coupled to the radial waveguide 3 via a ring-shaped waveguide 9 that is itself coupled to a coaxial waveguide 10 surrounding the circular waveguide 6, this coaxial waveguide being coupled to the radial waveguide 3. The ring-shaped waveguide 9 is placed coaxially on the outer periphery of the coaxial waveguide 10. The input waveguide 5 is fed with its $TE_{01}$ fundamental mode, the electric field of which, indicated in FIG. 1 by an arrow (perpendicular to the plane of the sheet), is perpendicular to the direction A. The $TE_{01}$ mode is propagated by the ring-shaped waveguide 9 into the coaxial waveguide 10 via linear coupling slots 11 distributed around the inner periphery of the ring, while the coaxial waveguide 10 is coupled to the radial waveguide 3 via radial coupling slots 12 fanning out from the rear face 2 of the antenna around the circular waveguide 6. The mean circumference of the ring-shaped waveguide 9 is a multiple of the wavelength of the guided wave in the $TE_{01}$ mode. In the embodiment illustrated, the coaxial cavity 10 is coupled via 12 radial stops 12 to the radial waveguide 3 and the mean inside circumference of the waveguide 9 is equal to twelve times the wavelength of the guided wave in the $TE_{01}$ mode.

Of course, the size of the coupling slots 11 and 12 and their distribution should be adjusted in order to obtain the desired performance of the antenna in terms of bandwidth, efficiency and matching.

This feed structure therefore makes it possible, from the rear face of the antenna, to excite the latter in two orthogonal linear polarizations while avoiding the presence of masking and perturbation regions at the front of the antenna.

The invention claimed is:

1. Network antenna of the RLSA type in the form of a radial waveguide and having a feed structure allowing simultaneous excitation of the antenna in two orthogonal linear polarizations, wherein the feed structure, essentially placed to the rear of the antenna, consists of a circular waveguide placed at the centre of the radial waveguide and coupled to the latter by two circular slots for the excitation of the antenna in a first linear polarization and of a coaxial waveguide surrounding the circular waveguide and coupled to the radial waveguide by radial slots, the coaxial waveguide being excited by a ring-shaped waveguide placed coaxially on the outer periphery of the coaxial waveguide and coupled to the latter by slots distributed around the inner periphery of the ring for the excitation of the antenna in a second linear polarization orthogonal to the first linear polarization.

2. Antenna according to claim 1, in which the first linear polarization is excited by means of a first rectangular input waveguide propagating the $TE_{01}$ fundamental mode, oriented along an axial direction of the antenna, in the circular waveguide.

3. Antenna according to claim 2, in which the second linear polarization is excited by means of a second rectangular input waveguide propagating the $TE_{01}$, fundamental mode, oriented in a direction perpendicular to the axial direction of the antenna, in the ring-shaped waveguide.

4. Antenna according to claim 3 in which the first and second rectangular input waveguides are placed parallel to each other.

5. Antenna according to claim 4, in which the first and second rectangular input waveguides are placed one beneath the other.

* * * * *